United States Patent [19]

Minato et al.

[11] Patent Number: 4,919,774

[45] Date of Patent: Apr. 24, 1990

[54] ELECTROLYTICALLY TREATING METHOD

[75] Inventors: Shinichiro Minato; Atsuo Nishino, both of Shizuoka, Japan

[73] Assignee: Fuji Photo Film Co., Ltd., Kanagawa, Japan

[21] Appl. No.: 234,860

[22] Filed: Aug. 22, 1988

[30] Foreign Application Priority Data

Aug. 21, 1987 [JP] Japan ..... 62-206584

[51] Int. Cl.[5] ..... C25F 3/00; C25F 1/00

[52] U.S. Cl. ..... 204/129.4; 204/129.43; 204/DIG. 8; 204/144.5

[58] Field of Search ..... 204/129.4, 129.43, 140, 204/144.5, DIG. 8, DIG. 9, 231, 33

[56] References Cited

U.S. PATENT DOCUMENTS 4,533,444 8/1985 Oda et al. ..... 204/DIG. 9
4,534,834 8/1985 Zdener ..... 204/DIG. 9
4,536,264 8/1985 Masuda et al. ..... 204/DIG. 9
4,597,837 7/1986 Oda et al. ..... 204/DIG. 9
4,741,812 5/1988 Kojima ..... 204/129.4

*Primary Examiner*—Donald R. Valentine
*Attorney, Agent, or Firm*—Sughrue, Mion, Zinn, Macpeak & Seas

[57] ABSTRACT

A method of continuously electrolytically treating a metal web in an electrolytic liquid using an alternating waveform current via a pair of main electrodes such that the surface of the metal web experiences both an anode reaction and a cathode reaction. The ratio of the current value contributing to the anode reaction acting on the surface of the metal web and the current value of the cathode reaction acting on the surface of the metal web is controlled by shunting a portion of the supplied current to an auxiliary electrode, which is separated from the main electrodes, as a direct current.

4 Claims, 4 Drawing Sheets

ELECTROLYTICALLY TREATING METHOD

BACKGROUND OF THE INVENTION

1. Field of the Invention

The present invention relates to a method of electrolytically treating a metal plate where the electrolytic reaction is optimally controlled.

2. Description of the Art

Examples of electrolytic treatment on a surface of metal such as aluminum, iron, or the like, include, for example, plating treatment, electrolytically surface-roughing treatment, electrolytically etching treatment, anode oxidation treatment, electrolytically coloring treatment, satin treatment, etc., which are used practically and widely. As a power supply, a suitable direct current, commercial alternating current, superimposed-waveform current, or any other alternating current of a specific or a rectangular waveform controlled by thyristors, etc., is selectively used in accordance with required quality and for the purpose of improvement in reaction efficiency.

FIG. 1 shows a specific example of a conventional system for continuously electrolytically treating a metal web by using graphite electrodes. A metal web 1 is conveyed into an electrolytic cell 4 by a guide roller 2, horizontally conveyed in the electrolytic cell 4 while supported by a support roller 3, and then conveyed out of the electrolytic cell 4 by a guide roller 5. The electrolytic cell 4 is divided into two chambers by an insulator 6. Graphite electrodes 8 and 9, which are main electrodes, are disposed respectively in the two chambers so as to oppose the metal web 1. An electrolyte 28 is stored in a circulation tank 29 and pumped by a pump 30 to electrolyte supply inlets 11 and 12 provided in the electrolytic cell 4. The electrolyte is returned to the circulation tank 29 through a discharge outlet 13, and occupies the gap between the metal web 1 and each of the graphite electrodes 8 and 9. A power source 14 is connected to the graphite electrodes 8 and 9 so as to apply a voltage thereto. In the thus arranged system, the metal web 1 can be continuously subjected to electrolytic treatment.

As the power source 14, a direct current waveform, an alternating waveform, a rectangular alternating waveform, or the like is utilized.

When a metal web is subject to electrolytic treatment, there is a very close relationship between the shape of the treated surface, such as desired pit diameter, pit period, etc., and the electrolytic current conditions. Therefore, the control of an electrolytic current is an important aspect of electrolytic treatment.

When a current of an alternating waveform is used as an electrolytic current, a ratio $\gamma$ of a forward current mean value I(n) to a reverse current mean value I(r), that is $\gamma=I(n)/I(r)$, is called a current ratio. In electrolytic treatment, it is known that the shape of a surface treated by electrolytic treatment varies considerably, particularly in accordance with the current ratio. For example, as disclosed in Japanese Patent Post-Examination Publication No. 56-19280, in the electrolytic treatment of an Al plate excellent surface-roughing treatment can be performed so that the Al plate can be an offset printing plate support by using an alternating waveform current supplied so that a voltage in the anode time is larger than a voltage in the cathode time, that is, the current ratio $\gamma=I(n)/I(r)<1$.

Conventionally, to control the foregoing current ratio, there have been proposed a method using an alternating current in which the ratio of a forward current mean value to a reverse current mean value is controlled by use of a special power source capable of generating an asymmetrical alternating waveform current, and a method in which a distance between a metal web and each electrode or an effective electrode area is changed.

In the former method, however, there has been a problem in that the power source is complicated thereby increasing the cost thereof or that the distribution of magnetic flux is biased in a transformer. In the latter method, on the other hand, there has been a problem in that the electrolytic treatment cell and electrodes are complicated in structure and therefore the method is not suitable for practical use.

SUMMARY OF THE INVENTION

An object of the present invention is to solve the foregoing problems in the prior art and to provide an electrolytic treating method in which an electrolytic reaction can be easily, accurately, and most suitably controlled by the use of conventional power source equipment without making the electrolytic cell and electrodes complicated in structure.

In order to solve the foregoing problems in the prior art, this invention provides a method of controlling the current ratio in an electrolytic current by using an auxiliary anode electrode.

According to the present invention, a metal web is continuously electrolytically treated in an electrolytic liquid using a power supply having an alternating waveform current by controlling the ratio of a current value contributing to an anode reaction acting on a metal web surface and a current value contributing to a cathode reaction acting on the same surface by shunting a part of a current value of the power supply as a direct current into an auxiliary anode electrode provided separately from a pair of main electrodes.

Preferably, the direct current caused to flow in the auxiliary anode electrode is a pulsating current. This is because in order to make the current ratio $\gamma=I(n)/I(r)>1$ with respect to the current flowing from the main electrode, it is easiest and preferable to change the value of the current shunted to the auxiliary electrode between the forward and reverse sides in the case of the present invention.

DESCRIPTION OF THE PREFERRED EMBODIMENT

Figure 2:
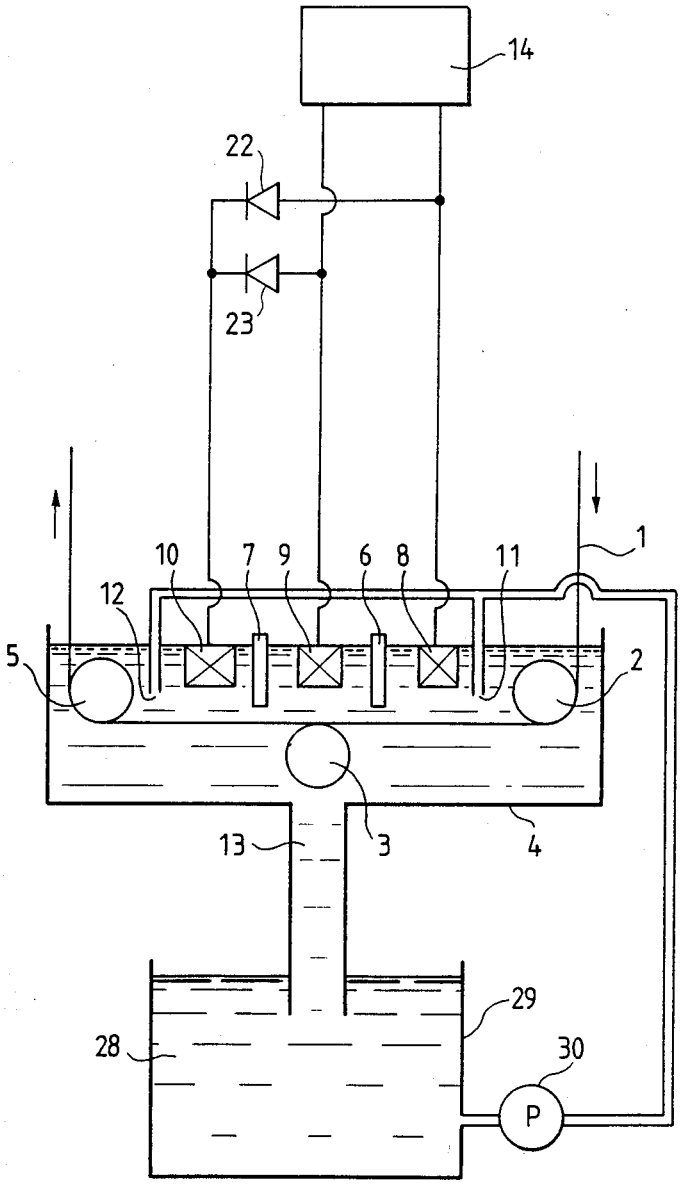
FIGS. 2 and 4 are schematic diagrams for explaining embodiments of the continuous electrolytic treatment system utilizing the electrolytically treating method according to the present invention.
Figure 3:
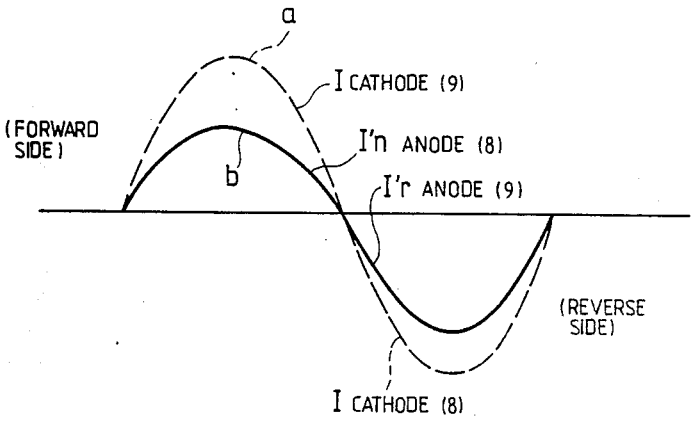
FIGS. 3 and 5 are diagrams for respectively explaining current waveform in the case where the methods of FIGS. 2 and 4 are utilized.

Referring to FIGS. 2 and 3, an embodiment of the present invention will be described in detail hereunder.

Figure 1:
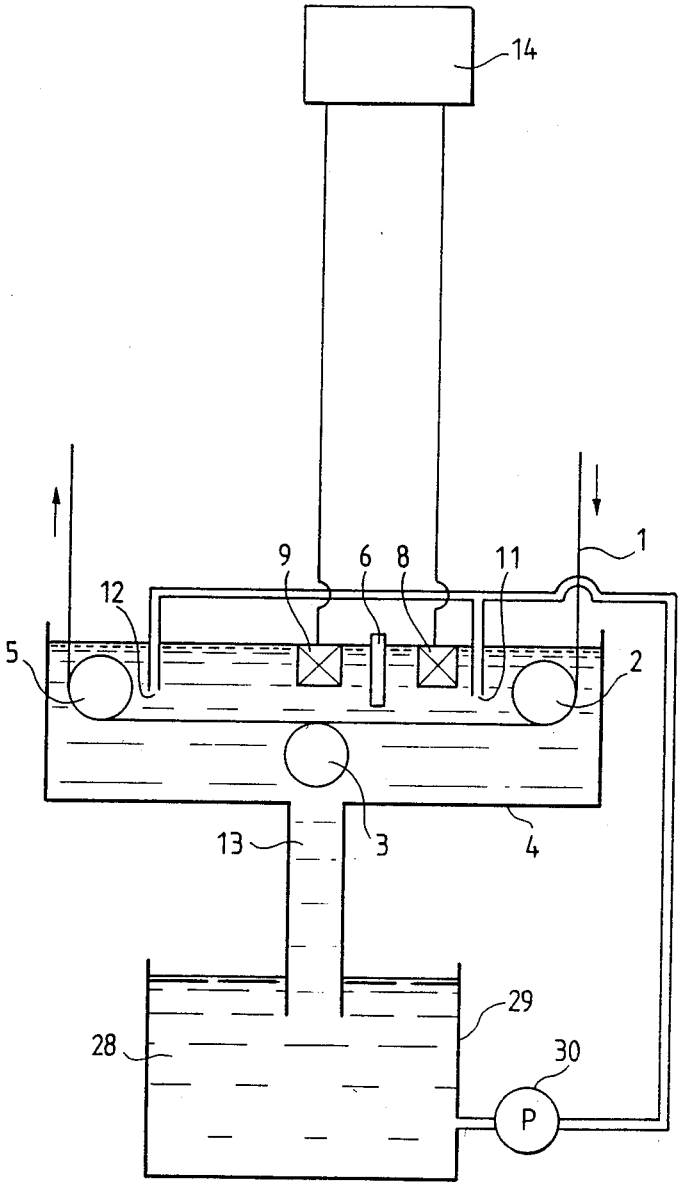
FIG. 1 is a schematic diagram for explaining an example of the conventional continuous electrolytic treatment system.

FIG. 2 is a diagram for explaining an embodiment of the method of continuously electrolytically treating a metal web according to the present invention. FIG. 3 shows an example of an alternating waveform current used in the embodiment of FIG. 1.

In FIG. 2, a metal web 1 is led into an electrolytic cell 4 by a guide roller 2, horizontally conveyed in the electrolytic cell 4 by a support roller 3, and conveyed out of the cell by a roller 5. A refractory auxiliary anode electrode 10 is disposed in the electrolytic cell 4 at a position opposite to the metal web 1. A refractory material for the auxiliary anode electrode 10 may be platinum, lead, or the like.

The electrolytic cell 4 is divided into three portions by insulators 6 and 7. The foregoing auxiliary anode electrode 10 and main graphite electrode 8a and 9 are disposed in the three portions respectively so as to be opposite to the metal web. An electrolyte 28 is sent by a pump 30 to electrolyte supply inlets 11 and 12 provided inside the electrolytic cell 4, and returned to a circulation tank 29 through a discharge outlet 13 while consuming a gap between the metal web 1 and each of the graphite electrodes 8 and 9 and the auxiliary anode electrode 10 disposed in opposition to the metal web 1. Generally, a heat exchanger and a filter which are not illustrated in the drawing are provided in a portion of a circulation system so that the electrolyte is accurately temperature-controlled and impurities are separated and removed from the electrolyte.

An alternating waveform current as shown by a broken line a in FIG. 3 can be made to flow from a power source 14 into the electrolytic cell 4 having such an electrode arrangement as described above.

In the method according to the present invention, the fact that a part of a current value is shunted as a direct current into the auxiliary anode electrode provided separately from the main electrodes means that, for example, the forward side terminal of the power source 14 is connected to the main graphite electrode 8 and to the auxiliary anode electrode 10 through a thyristor or diode 22 and the reverse side terminal of the power source 14 is connected to the main graphite electrode 9 and to the auxiliary anode electrode 10 through a thyristor or diode 23 similarly to the forward side terminal.

Further, the control of the ratio of a current value contributing to an anode reaction acting on a metal web surface and a current value contributing to a cathode reaction acting on the same surface can be performed, for example, by controlling a current flowing into the auxiliary anode electrode 10. The control of current may be realized by controlling the gate time of a thyristor, or by providing a variable resistor or the like in an electric circuit in the case of a diode. Alternatively, the control of current can be performed by controlling a distance between the auxiliary anode electrode 10 and the metal web 1 or an effective electrode area of the auxiliary anode electrode 10. Further, although not illustrated in FIG. 2, an electrolytic cell and an electrolyte circulation tank may be provided exclusively for the auxiliary anode electrode 10, and the various conditions such as the kind of electrolyte, condition of the electrolytic bath temperature, etc., may be changed in accordance with requirement.

Referring to FIG. 2, the flow of the electrolytic current will be described. In the case of a forward current, the forward current I(n) generated from the power source 14 is shunted to the graphite electrode 8 and the auxiliary anode electrode 10. Here, the current I(n) is expressed as follows:

$$I(n)=I'(n)+\beta(n)$$

$$\beta(n)>0$$

where I'(n) and $\beta$(n) represent currents flowing into the graphite electrode 8 and the auxiliary anode electrode 10, respectively. These currents flow into the metal web 1 through the electrolyte 28. At that time, an anode reaction is caused on the respective surfaces of the graphite electrode 8 and the auxiliary anode electrode 10, while a cathode reaction is cause on the surface of the metal web 1 opposite to the electrodes.

The forward current further flows from the metal web 1 into the graphite electrode 9 through the electrolyte 28 and returns to the power source 14. At that time, a cathode reaction is caused on the surface of the graphite electrode 9, while an anode reaction by the forward current I(n) is caused on the surface of the metal web 1 opposite to the graphite electrode 9.

In the case of a reverse current, the reverse current I(r) generated from the power source 14 is shunted into the graphite electrode 9 and the auxiliary anode electrode 10. Here, the current I(r) is expressed as follows:

$$I(r)=I'(r)+\beta(r)$$

$$\beta(r)>0$$

where I'(r) and $\beta$(r) represent currents flowing into the graphite electrode 9 and the auxiliary anode electrode 10, respectively.

These currents flow into the metal web 1 through the electrolyte 28. At that time, an anode reaction is caused on the surfaces of the graphite electrode 9 and auxiliary anode electrode 10, while a cathode reaction is caused on the surface of the metal web 1 opposite to those electrodes. The reverse current further flows from the metal web 1 into the graphite electrode 8 through the electrolyte 28, and returns to the power source 14. At that time, a cathode reaction is caused on the surface of the graphite electrode 8, while an anode reaction is caused on the metal web 1 opposite to the graphite electrode 8. FIG. 3 shows an electrolyte current waveform in the embodiment of FIG. 2. The electrolytic current flowing into the main graphite electrodes 8 and 9 electrodes has a waveform shown by a solid line b in FIG. 3 because the current having the waveform a is shunted into the auxiliary anode electrode 10.

In order to control the electrolytic reaction of the metal web 1, therefore, a ratio of the forward current to the reverse current, both of which contribute to the reaction, can be controlled by changing the waveform shown by the solid line b in FIG. 3 so as to control the currents $\beta$(n) and $\beta$(r) shunted to the auxiliary anode electrode 10.

Figure 5:
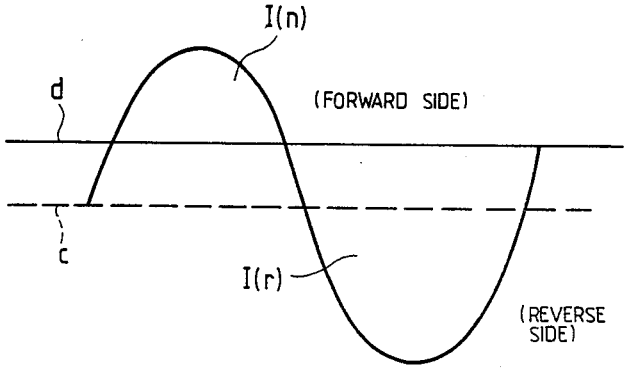
Figure 4:
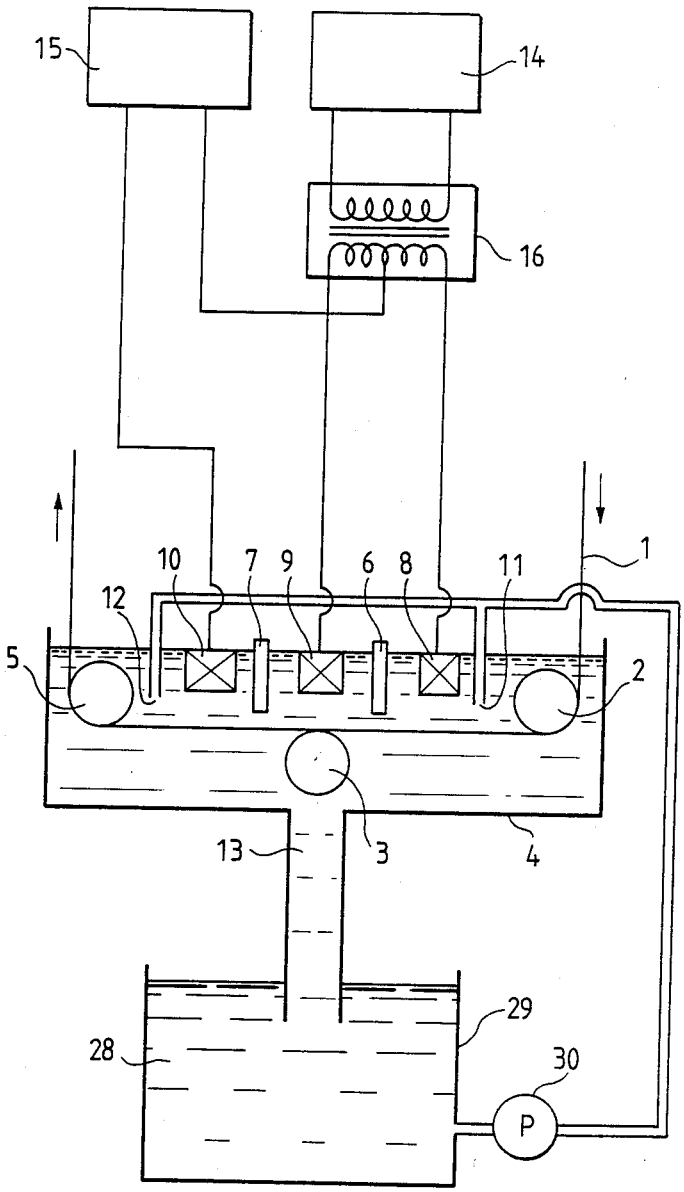

FIG. 4 shows another embodiment of the present invention which uses a direct current auxiliary power source 15 for exclusively supplying a current to an auxiliary anode electrode 10 and a transformer 16 for deriving a neutral point. FIG. 5 shows an electrolytic current waveform in this embodiment.

A zero line of the electrolytic current contributing to the reaction is shifted from a line c to a line d in FIG. 5 by a current generated from the direct current auxiliary power source 15 to thereby control the ratio of the forward current to the reverse one.

Description has been thus made as to the embodiments of the present invention. According to the invention the current ratio of electrolytic currents contributing to electrolytic reactions is controlled by using an auxiliary anode electrode.

It is therefore a matter of course that the present invention is not limited by the shape of the electrolytic cell, the number of division of the same, the order of arrangement of the electrodes, or the kind of electrolyte. Further, the alternating waveform current is not limited by its asymmetrical property or the kind of waveform.

EXAMPLES

In order to clearly show the effects of the present invention, examples of the present invention will be described hereunder.

Example 1

Continuous electrolytic surface-roughing treatment on an aluminum plate to be used as a support of an offset printing plate was carried out in a 1% aqueous solution of nitric acid at a temperature of 35° C. by use of an alternating waveform current as shown in FIG. 5 with an electrode arrangement as shown in FIG. 4. Graphite electrodes were used as main electrodes, and a platinum electrode was used as an auxiliary anode electrode. The continuous electrolytic treatment was carried out for 6 hours at a treatment speed of 1 m/min under the conditions that the forward current I(n)=300(A) and the reverse current I(r)=300(A). Further, as the shunting of the forward current to the graphite electrode, used as a main electrode, and the auxiliary anode electrode, an effective electrode length of the auxiliary anode electrode is varied to thereby change the shunted currents $\beta$(n) and $\beta$(r). Table 1 shows the result of experiments.

TABLE 1

| No. | I(n) (A) | I(r) (A) | $\beta$(n) (A) | $\beta$(r) (A) | State of graphite electrode | State of surface after electrolytic treatment |
|---|---|---|---|---|---|---|
| 1 | 300 | 300 | 0 | 0 | a little waste | good |
| 2 | 300 | 300 | 30 | 10 | no waste | good |
| 3 | 300 | 300 | 60 | 20 | no waste | good |

In the above-mentioned condition No. 1, that is, in the state where no auxiliary anode electrode was used or $I(n)/I(r)=1$, waste was caused in the graphite electrode. Therefore, it was found that the conditions of No. 1 were not suitable for running for a long time. In the case of $\beta$(n) and $\beta$(r) of Nos. 2 and 3, on the other hand, $I(n)/I(r)<1$, and it was found that no waste was caused in the electrode and the surface state after electrolytic treatment was satisfactory. Although the surface shape was changed by changing the current values $\beta$(n) and $\beta$(r), in all cases, it was possible to obtain an excellent roughing treated surface for a support of an offset printing plate.

Example 2

An experiment was performed in a 1% aqueous solution of hydrochloric acid at a temperature of 35° C. under the same conditions a those of Example 1. The state of all the surfaces after electrolytic treatment was satisfactory and the same results as those of Table 1 were obtained. Although the thus obtained surface shapes were slightly different from those obtained in Example 1, an excellently roughing-treated surface for a support of an offset printing plate was obtained.

As is apparent from the foregoing description of the embodiment of the present invention, the present invention provides the following advantages.

Because the current ratio $\gamma=I(n)/I(r)$ of currents flowing from a main electrode is set to a value smaller than "1" in conventional electrolytic conditions, a current flowing into the main electrode is an asymmetrical alternating current. Conventionally, therefore, there have been disadvantages in that it is necessary to increase the capacity of a transformer and to control the biased magnetization of the electrolytic current, and the electrolytic power source system is increased in size or becomes complicated. According to the present invention, however, a method of continuously electrolytically treating a metal web through liquid using an alternating waveform current, a direct current is caused to flow into an auxiliary anode electrode provided separately from main electrodes to thereby control a ratio of the amount of current contributing to an anode reaction acting on a metal web surface and the amount of current contributing to a cathode reaction acting on the same surface. Thus, the ratio of current flowing into the main electrodes can be freely set to a desired value by controlling the current flowing into the auxiliary anode electrode. Accordingly, according to the present invention, a symmetrical alternating current can be used as a power source by setting the current ratio $\gamma=1$, and the electrolytic power source system can be reduced in size or simplified because conventional power source equipment can be used. Thus, it is possible to reduce the costs of the equipment without making the electrolytic cell or the electrode arrangement complicated and it is possible to easily, accurately, and most suitably control the electrolytic reaction.

We claim:

1. A method of continuously electrolytically treating a metal web, comprising the steps of:
   - conveying said web in an electrolytic liquid;
   - supplying an alternating waveform current to said electrolytic liquid via a pair of main electrodes such that a surface of said metal web experiences an anode reaction and a cathode reaction;
   - controlling a current value contributing to said anode reaction acting on said metal web surface and a current value contributing to said cathode reaction acting on said metal web surface so as to control the ratio thereof by supplying a direct current to an auxiliary anode electrode, said auxiliary anode electrode being separate from said main electrodes.

2. A method of continuously electrolytically treating a metal web, comprising the steps of:
   - conveying said web in an electrolytic liquid;
   - supplying an alternating waveform current to said electrolytic liquid via a pair of main electrodes such that a surface of said metal web experiences an anode reaction and a cathode reaction;
   - controlling the ratio of a current value contributing to said anode reaction acting on said metal web surface and a current value contributing to said cathode reaction acting on said metal web surface by supplying a direct current to an auxiliary anode electrode, said auxiliary anode electrode being separate from said main electrodes, wherein said direct current is supplied by shunting a portion of said supplied alternating current as a direct current.

3. The method of continuously electrolytically treating a metal web according to claim 2, wherein said direct current shunted to said auxiliary anode electrode is in the form of a pulsating current.

4. A method of continuously electrolytically treating a metal web, comprising the steps of:

conveying said web in an electrolytic liquid;

supplying an alternating waveform current to said electrolytic liquid via a pair of main electrodes such that a surface of said metal web experiences an anode reaction and a cathode reaction;

controlling the ratio of a current value contributing to said anode reaction acting on said metal web surface and a current value contributing to said cathode reaction acting on said metal web surface by supplying a direct current to an auxiliary anode electrode, said auxiliary anode electrode being separate from said main electrodes, wherein said direct current is supplied by an auxiliary power source.

* * * * *